US011029035B2

(12) United States Patent
Yang et al.

(10) Patent No.: US 11,029,035 B2
(45) Date of Patent: Jun. 8, 2021

(54) OVEN

(71) Applicant: LG Electronics Inc., Seoul (KR)

(72) Inventors: Haksoon Yang, Seoul (KR); Jaekyung Yang, Seoul (KR); Semi Lee, Seoul (KR); Suyong Lee, Seoul (KR); Yongsoo Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 183 days.

(21) Appl. No.: 16/270,106

(22) Filed: Feb. 7, 2019

(65) Prior Publication Data

US 2019/0301747 A1 Oct. 3, 2019

(30) Foreign Application Priority Data

Apr. 3, 2018 (KR) ..... 10-2018-0038644

(51) Int. Cl.
*F24C 15/02* (2006.01)
*E05D 15/52* (2006.01)

(52) U.S. Cl.
CPC ..... *F24C 15/028* (2013.01); *E05D 15/52* (2013.01); *F24C 15/023* (2013.01); *F24C 15/024* (2013.01)

(58) Field of Classification Search
CPC ..... F24C 15/028
USPC ..... 126/194; 16/232
See application file for complete search history.

(56) References Cited

U.S. PATENT DOCUMENTS 3,018,508 A 1/1962 Keeling
3,018,509 A * 1/1962 Sherman ..... F24C 15/02 16/232
3,030,656 A 4/1962 Hopkins
3,623,764 A * 11/1971 Jacobus ..... B60J 5/103 296/50
2006/0001288 A1* 1/2006 Thiele ..... E05D 15/505 296/50
2016/0076186 A1 3/2016 Lee et al.

FOREIGN PATENT DOCUMENTS

JP H0554913 7/1993
KR 1020130011486 1/2013
KR 1020160032995 3/2016
KR 1020160111206 9/2016

OTHER PUBLICATIONS

European Search Report in European Appln. No. 18189335.5, dated Dec. 6, 2018, 11 pages.

* cited by examiner

*Primary Examiner* — Avinash A Savani
(74) *Attorney, Agent, or Firm* — Fish & Richardson P.C.

(57) ABSTRACT

The present invention provides an oven including: a cabinet having a cooking space open forward; a door rotating to open/close the cooking space; and a rotary hinge disposed on the front of the cabinet to rotate the door in various directions, in which the door includes: a first ink moving in a first direction; and a second link moving in a second direction perpendicular to the first direction by movement of the first link, and the rotational direction of the door depends on movement of the first link.

21 Claims, 13 Drawing Sheets

OVEN

CROSS-REFERENCE TO RELATED APPLICATIONS

The present application claims priority under 35 U.S.C. 119 and 35 U.S.C. 365 to Korean Patent Application No. 10-2018-0038644, filed on Apr. 3, 2018, which is hereby incorporated by reference in its entirety.

FIELD

The present invention relates to an oven with a door.

BACKGROUND

In general, an oven can cook by heating food in its closed cooking space. Accordingly, the oven may have a body having a cooking space and a door for closing the body.

The door can be hinged to selectively open or close the cooking space.

The door can be formed in a pull-down type in which the door is hinged to the lower end of the body to open/close the cooking space and a side-swing type in which the door is hinged to a side end of the body to open/close the cooking space.

The pull-down type door (hereafter, a pull-down door) has a problem that it interferes with the user when it is open. For example, the pull-down door is inconvenient because a user has to obliquely put food into the cooking space from the side of the oven, which Further, a user has to clean the inside of the oven in an inconvenient position.

The side-swing type door (hereafter, a side-swing door) can solve the problems of the pull-down door, but it also has a problem that it cannot provide the function of a temporal shelve that the pull-down door can provide. For example, according to the side-swing door, it is difficult for disabled users, children, and old people etc. to carry heavy food to the cooking space.

In the related art, oven doors have been disclosed in the following documents.

1. Korean Patent Application Publication No. 10-2013-0011486 (published on Jan. 30, 2013, titled "Oven door")

2. Korean Patent Application Publication No. 10-2016-0111206 (published on Sep. 26, 2016, titled "Hinge apparatus and oven with hinge)

SUMMARY

The present invention has been made in an effort to solve the problems and an object of the present invention is to provide an oven allowing a user to select door-opening types.

Another object of the present invention is to provide an oven allowing a user to easily change door-opening types. In particular, another object of the present invention is to provide an oven allowing a user to easily switch a pull-down type and a side-swing type.

Another object of the present invention is to provide an oven having a door that can be opened in two directions.

Another object of the present invention is to provide an oven capable of providing both of a pull-down door and a side-swing door.

An oven according to an embodiment of the present invention may include: a cabinet having a cooking space open forward; a door rotating to open/close the cooking space; and a rotary hinge disposed on the front of the cabinet to rotate the door in various directions.

The door includes: a first ink moving in a first direction; and a second link moving in a second direction perpendicular to the first direction by movement of the first link, and the rotational direction of the door depends on movement of the first link.

An oven according to another embodiment of the present invention includes: a cabinet having a cooking space open forward; a door rotating to open/close the cooking space; and a rotary hinge disposed on the cabinet to rotate the door in various directions, in which the door includes: a first ink moving in a first direction; and a second link moving in a second direction perpendicular to the first direction by movement of the first link, and the door opens/closes the cooking space selectively in any one of a first mode in which the door is rotated about a side end of the cabinet a second mode in which the door is rotated about the lower end of the cabinet, depending on movement of the first link.

The ovens having the configurations according to embodiments of the present invention have the following effects.

First, a user can select the opening type of the door, so the oven is more useful.

Second, since both of a pull-down type and a side-swing type are provided for the ovens, the ovens can be more conveniently used.

Third, since the opening type of the door is selectively changed, the ovens can be more useful.

Fourth, since a user can easily switch the opening types of the door through the operation unit, it is easy to use the ovens.

Fifth, according to the present invention, it is possible to more easily carry food and clean the ovens, as compared with existing ovens, so the functionality is improved.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from the spirit or scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present invention. Each of these terminologies is not used to define an essence, order or sequence of a corresponding component but used merely to distinguish the corresponding component from other component(s).

Figure 1:
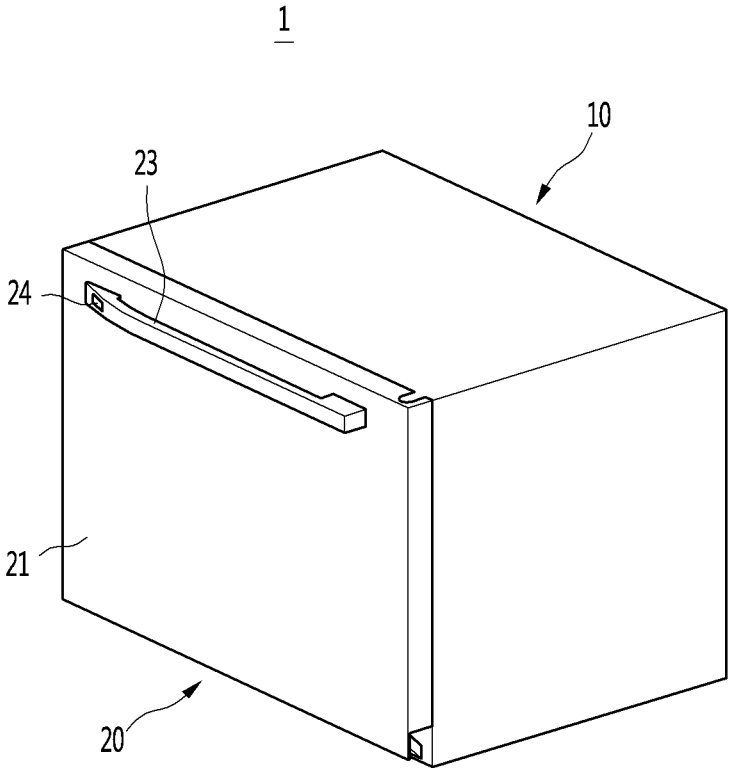
FIG. 1 is a perspective view showing the external appearance of an oven according to an embodiment of the present invention.
Figure 2:
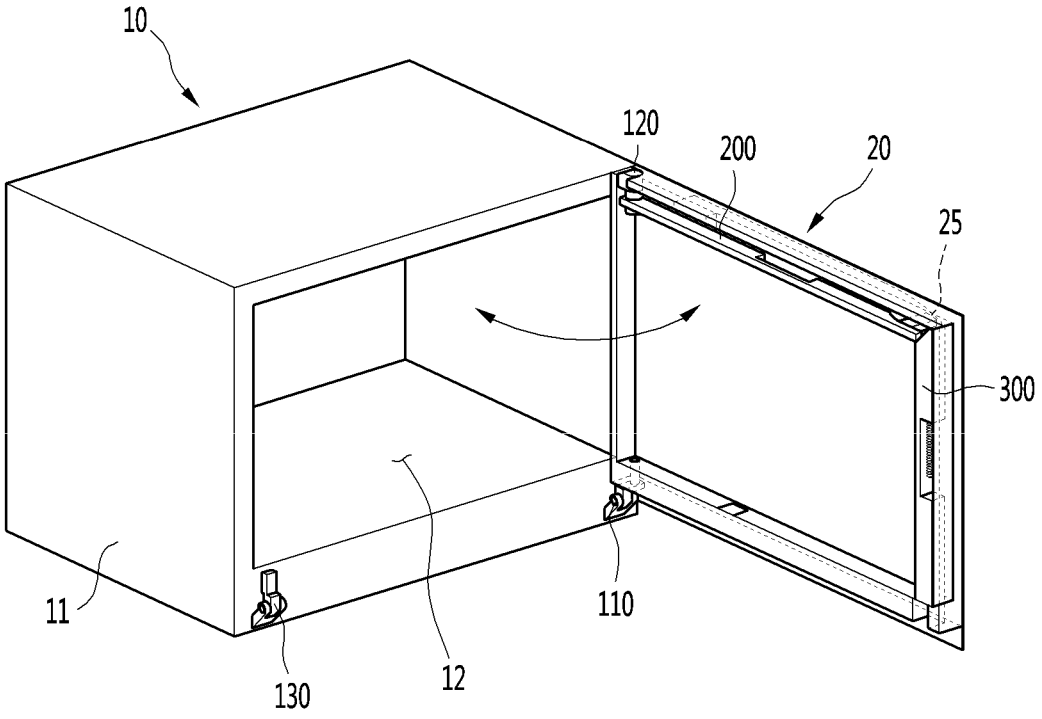
FIG. 2 is a view showing that a door according to an embodiment of the present invention is opened in a first mode.

FIG. 1 is a perspective view showing the external appearance of an oven according to an embodiment of the present invention and FIG. 2 is a view showing that a door according to an embodiment of the present invention is opened in a first mode.

Referring to FIGS. 1 and 2, an oven 1 according to an embodiment of the present invention may include a body 10 having an internal cooking space 12 and a door 20 attached to the front of the body 10 and being capable of opening/closing to selectively open the cooking space 12.

In an embodiment of the present invention, the door 20 can provide both of a pull-down type and a side-swing type.

It is determined as a first mode of the door 20 when the side-swing type is selected and it is determined as a second mode of the door 20 when the pull-down type is selected.

That is, the door 20 can be rotated to open/close the cooking space 12 selectively in any one of the first mode in which it is rotated about a side end of the body 10 and the second mode in which it is rotated about the lower end of the body 10.

The body 10 may include a hexahedral cabinet 11 forming the cooking space 12 that is open forward. Obviously, the body 10 may further include an out case (not shown) forming the external appearance of the oven 1 by covering the cabinet 11.

The cabinet 11 may include a plurality of plates. For example, the cabinet 11 may include a lower plate forming the bottom, side plates extending upward respectively from both sides of the lower plate, an upper plate covering the tops of the side plates, and a rear plate extending from the rear end of the lower plate to the upper plate.

The cooking space 12 can be defined by the plates. That is, the internal space formed by the plates can be defined as the cooking space 12. Accordingly, the cooking space 12 can be opened forward.

The opening direction of the internal space 12 of the cabinet 11 is defined as the forward direction with reference to FIG. 2.

The front of the cabinet 11 can be formed by front ends of the lower plate, the side plates, and the upper plate. The door can be rotatably coupled to the front of the cabinet 11. Accordingly, the door 20 can open/close the front opening of the cabinet 11, that is, the internal space 12.

The body 10 may include a rotary hinge 110, a fixed hinge 120, and a coupling hinge 130 for coupling the door 20.

The rotary hinge 110, the fixed hinge 120, and the coupling hinge 130 may be disposed on the front of the cabinet 11.

The rotary hinge 110 may be coupled to a side of the lower end of the cabinet 11.

The rotary hinge 110 may include a shaft for rotating the door 20 in the first mode and a shaft for rotating the door 20 in the second mode. That is, the rotary hinge 110 can rotate and guide the door 20 in multiple directions. The detailed configuration of the rotary hinge 110 will be described below.

The fixed hinge 120 may be spaced apart upward from the rotary hinge 110. For example, the fixed hinge 120 may be disposed at a side of the upper end of the cabinet 11.

The fixed hinge 120 may include a shaft protruding forward from the front of the cabinet 11 and extending downward. The fixed hinge 120 can be detachably coupled to a horizontal link 200 to be described below.

The shaft of the fixed hinge 120 can be considered as a shaft for rotating the door 20 in the first mode in cooperation with the rotary hinge 110.

The coupling hinge 130 may be spaced apart laterally from the rotary hinge 110. For example, the coupling hinge 130 may be disposed at the other side of the lower end of the cabinet 11. The coupling hinge 130 can be detachably coupled to a vertical link 300 to be described below.

The rotary hinge 110 is referred to as a first hinge, the fixed hinge 120 is referred to as a second hinge, and the coupling hinge 130 is referred to as a third hinge.

Figure 3:
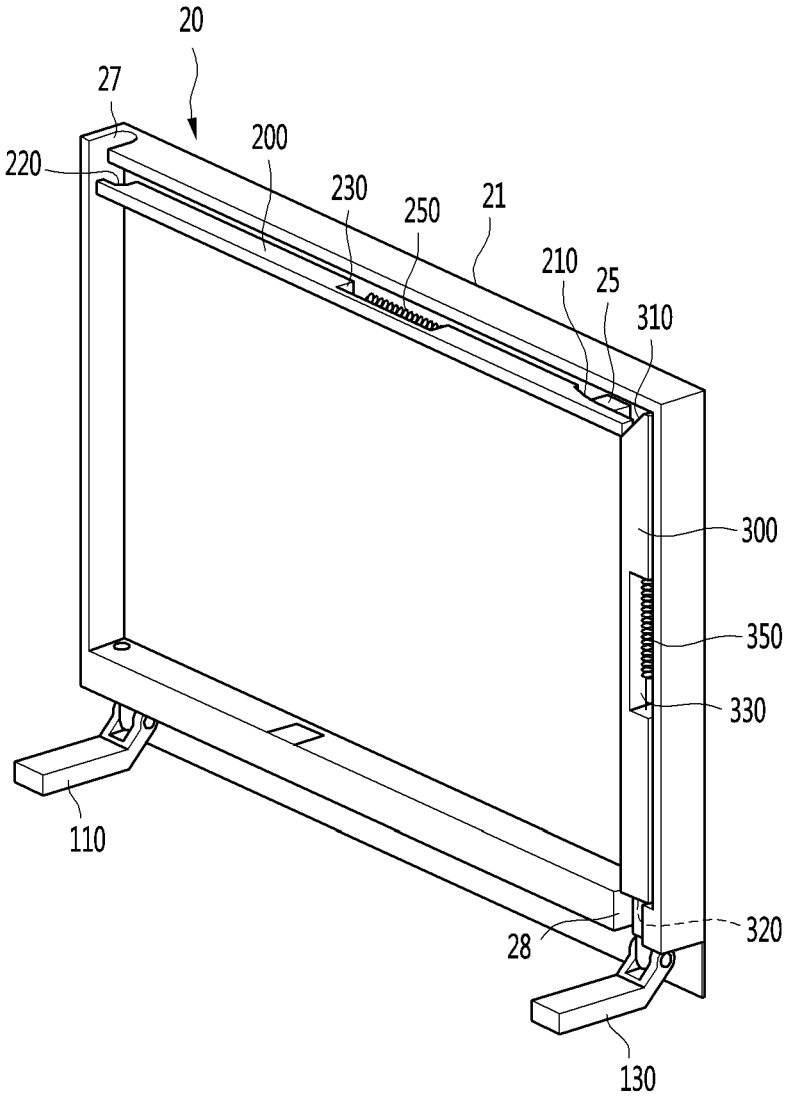
FIG. 3 is a perspective view showing the first mode of the door according to an embodiment of the preset invention.
Figure 4:
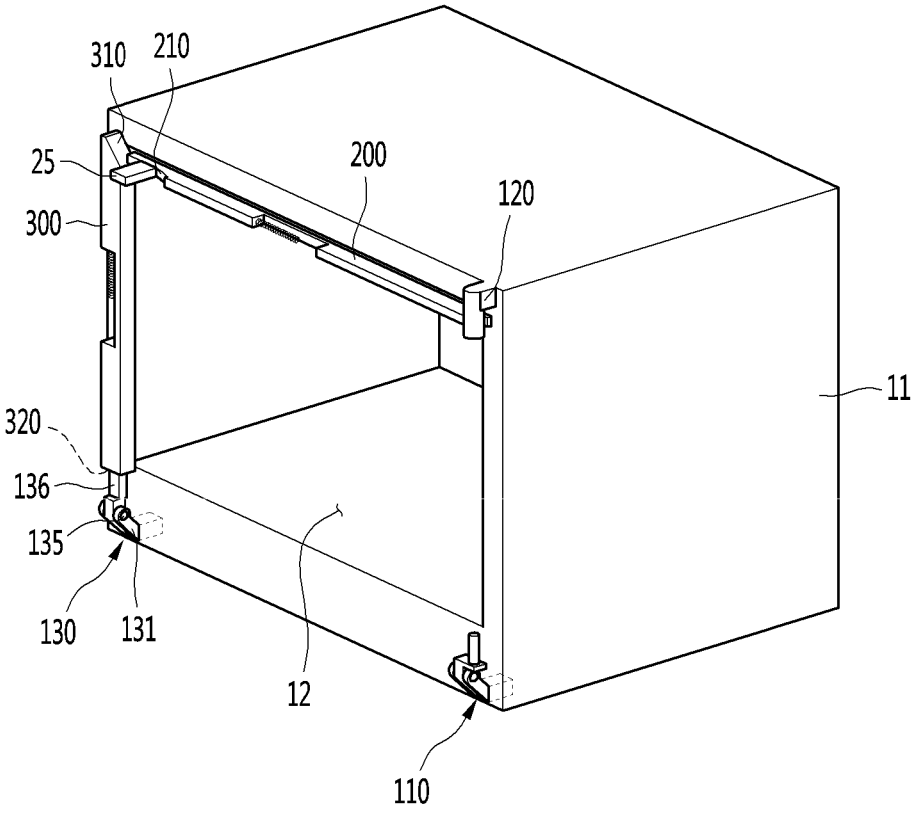
FIG. 4 is a view showing the connection relationships between some components and a body according to an embodiment of the present invention.
Figure 5:
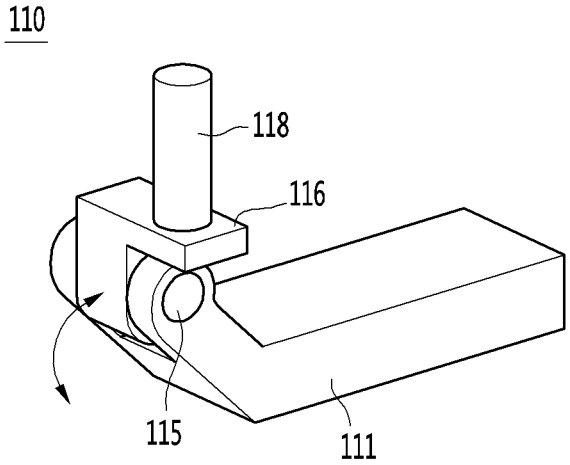
FIG. 5 is an enlarged view showing a rotary hinge according to an embodiment of the present invention.

FIG. 3 is a perspective view showing the first mode of the door according to an embodiment of the preset invention, FIG. 4 is a view showing the connection relationships between some components and a body according to an embodiment of the present invention, and FIG. 5 is an enlarged view showing a rotary hinge according to an embodiment of the present invention. In detail, FIG. 3 is a perspective view showing the door in the first mode from the rear and FIG. 4 is a view showing the assembly of the links and the cabinet with a door case removed.

Referring to FIGS. 2 to 4, the door 20 may include a door case 21 forming the external appearance of the door 20, a handle 23 disposed on the door case 21, and an operation unit 25 for switching the modes of the door 20.

The door case 21 may be rotatably coupled to the first to third hinges. The door case 21 may be selectively coupled to the first to third hinges.

In the door case 21, the front is a smooth plane and the rear has a space where the horizontal link 200 and the vertical link 300 are disposed. For example, the door case 21 may have a hexahedral shape with an open rear.

The door case 21 may have a side door groove 27 to which the fixed hinge 120 is coupled. The shaft of the fixed hinge 120 may be inserted and fixed in the side door groove 27.

The side door groove 27 may be formed at a position corresponding tot eh position of the fixed hinge 120 coupled to the cabinet 11. For example, the side door groove 27 may be a groove recessed forward at a side of the upper end of the door case 21. A link groove 220 of the horizontal link 200 may be formed under the side door groove 27.

The door case 21 may have a down door groove 28 in which the coupling hinge 130 is inserted. A coupling portion 136 of the coupling hinge 130 may be inserted in the down door groove 28. Accordingly, the coupling portion 136 can be coupled to the lower end of the vertical link 300 by up-down movement of the vertical link 300.

The handle 23 that a user can hold and the operation unit 25 for selecting the rotational direction of the door 20 may be disposed on the front of the door case 21.

The operation unit 25 may be disposed in the handle 23. For example, the operation unit 25 may be disposed through a side the handle 23. The operation unit 25 may be operated in a button type.

Accordingly, a user can simply operate the operation unit 25 through the handle 23 that he/she holds to open/close the door 20.

The operation unit 25 may include a button having a rectangular parallelepiped shape. For example, when a user initially presses the operation unit 25, the operation unit 25 is pushed forward into the handle 23 and the door case 21, thereby being able to press the horizontal link 200. When the user presses again the operation unit 25, the operation unit 25 protrudes backward, whereby the horizontal link 200 can be released.

That is, the operation unit 25 is operated by a user such the horizontal link 200 and the vertical link 300 are moved in predetermined directions. Accordingly, the user can simply select the first mode or the second mode of the door 20 by operating the operation unit 25.

The door 20 may further include the horizontal link 200 that can be moved in a first direction and the vertical link 300 that can be moved in a second direction by movement of the horizontal link 200.

The movement direction (first direction) of the horizontal link 200 may be perpendicular to the movement direction (second direction) of the vertical link 300. For example, if the horizontal link 200 is move in both of left and right directions, the vertical link 300 can be moved up and down.

The horizontal direction of the door case 21 is defined as a first direction and the vertical direction of the door case 21 is defined as a second direction.

The rotational directions of the door 20, that is, the modes of the door 20 can be selected by whether the horizontal link 20 is moved.

In detail, when the horizontal link 200 is moved to a side of the door case 21, the fixed hinge 120 and the horizontal link 200 can be coupled to each other. Accordingly, the door 20 can open/close the cooking space 12 in the first mode in which it is rotated about a side end of the cabinet 11.

When the horizontal link 200 is moved in the other lateral direction of the door case 21 and returned to the initial position, the fixed hinge 120 and the horizontal link 200 can be separated and the vertical link 300 and the coupling hinge 130 can be coupled to each other. Accordingly, it is possible to open/close the cooking space 12 in the second mode in which it is rotated about the lower of the cabinet 11.

The horizontal link 200 and the vertical link 300 may have bars elongated in a predetermined direction on the rear of the door case 21.

The horizontal link 200 may be elongated in both lateral directions of the door case 21. The horizontal link 200 may be disposed on the upper end of the rear of the door case 21.

The horizontal link 200 may have a link groove 220 and guide 210 that are formed at both ends, respectively. In detail, the link groove 220 may be formed at an end of the horizontal link 200 and the guide 210 may be formed at the other end of the horizontal link 200.

The link groove 220 may be separably coupled to the fixed hinge 120. For example, the link groove 220 is coupled to the fixed hinge 120 in the first mode and is separated from the fixed hinge 120 in the second mode.

In the first mode, the link groove 220 may be positioned under the side door groove 27. The link groove 220 may be a round groove to receive the shaft of the fixed hinge 120.

The horizontal link 200 can be moved by the operation unit 25. For example, when a user initially presses the operation unit 25, the operation unit 25 is pressed into the door case 21, thereby being able to press the guide 210 of the horizontal link 200. The pressing direction of the operation unit 25 may be perpendicular to the movement directions of the horizontal link 200 and the vertical link 300.

That is, the guide 210 can be moved in the first direction by the force that is applied by the operation unit 25. That is, the operation unit 25 can move the horizontal link 200 toward the sides of the door case 21 by pressing the guide 210.

Further, the guide 25 can move the vertical link 300 in the second direction by pressing the upper end of the vertical link 300. That is, the guide 210 can transmit force so that the vertical link 300 is moved up and down with respect to the door case 21.

The guide 210 may be elongated such that the width is decreased toward the end. For example, the width of the end of the guide 210 may be smaller than the width of the center portion of the horizontal link 200. Accordingly, a slope can be formed on the front of the guide 210.

The guide may have a pressing portion 211 that comes in contact with the vertical link 300, an inclined portion 215 that the operation unit 25 comes in contact with, and a stopping portion 217 to which the operation unit 25 is locked.

The pressing portion 211 may be positioned at the end of the guide 210. The pressing portion 211 can transmit force to a slide slope 310 (described below) formed at the upper end of the vertical link 300 by coming in contact with the slide slope 310.

That is, the pressing portion 211 can be laterally moved in contact with the slide slope 310. Accordingly, the pressing portion 211 can laterally move while pushing down the inclined slide slope 310. Accordingly, downward force can be applied to the vertical link 300.

In detail, the pressing portion can transmit force while sliding on the slide slope 310. For example, when the operation unit 25 pressing the horizontal link 200 is released, that is, the horizontal link 200 is moved in the other direction and returned to the initial position by elasticity, the pressing portion 211 can press down the vertical link 300 while sliding from the lowermost end to the uppermost end of the slide slope 310. Therefore, the horizontal link 200 is returned to the initial position and the vertical line 300 is moved down.

On the contrary, when the horizontal link 200 is pressed and moved in a predetermined lateral direction by the operation unit 25, the pressing portion 211 is moved in the direction and the force pressing the vertical link 300 is gradually removed, so the vertical link 300 can be moved up by elasticity.

The inclined portion 215 may be formed on the front of the guide 210. For example, the inclined portion 215 may be formed such that the width of the guide 210 is decreased in the elongation direction. That is, the inclined portion 215 may be formed such that a portion of the front of the guide 210 is inclined inward toward the vertical link 300.

When the operation unit 25 is pressed, it can transmit force while sliding on the inclined portion 215. Accordingly, the horizontal link 200 can be moved by the force applied by sliding on the inclined portion 215.

The stopping portion 217 may be vertically elongated forward from the inclined portion 215. The stopping portion 217 may be formed in a shape corresponding to a side of the operation unit 25. For example, the stopping portion 217 may be a surface protruding forward from an end, which is closer to the center of the horizontal link 200, of the inclined portion 215.

The stopping portion 217 prevents separation of the operation unit 25 moving on the inclined portion 215. For example, when the operation unit 25 is returned outward, the force pressing the inclined portion 215 by the operation unit 25 is removed, so the horizontal link 200 can be returned to the initial position. Further, when the horizontal link 200 is returned to the initial position, the operation unit 25 can be locked by the stopping portion 217 with the side in contact with the stopping portion 217. Accordingly, the horizontal link 200 can be returned to the fixed position.

The horizontal link 200 may further include a horizontal elastic member 250 providing elasticity for returning the horizontal link 200 and a horizontal mount 230 where the horizontal elastic member 250 is disposed.

The horizontal elastic member 230 may be disposed at the center portion of the horizontal link 200. The horizontal mount 230 may be a space recessed inward.

The horizontal elastic member 250 may include a spring. The horizontal elastic member 250 may be disposed in the horizontal mount 230.

The horizontal elastic member 250 can be stretched and contracted by movement of the horizontal link 200.

The horizontal elastic member 250 can be contracted when the horizontal link 200 is moved in a predetermined direction toward the side door groove 27 of both lateral directions of the door case 21. The elasticity accumulated by contraction of the horizontal elastic member 250 can be applied in the opposite direction of the movement direction of the horizontal link 200.

Accordingly, when the horizontal link 200 pressed by the operation unit 25 is released, the horizontal link 200 is moved in the opposite direction toward the vertical link 300 by the elasticity of the horizontal elastic member 250, whereby it can be returned to the initial position.

The vertical link 300 may be positioned perpendicular to the horizontal link 200. That is, the vertical link 300 may be vertically positioned in contact with the horizontal link 200.

The vertical link 300 may be elongated up and down with respect to the door case 21. The vertical link 300 may be positioned at a side of the door case 21. For example, the vertical link 300 may be positioned at the end of the door case 21 where the down door groove 28, where the coupling hinge 130 is disposed, is formed. That is, the vertical link 300 may be positioned over the coupling hinge 130.

The vertical link 300 may have the slide slope 310 that the horizontal link 200 comes in contact with and a coupling portion 320 separably coupled to the coupling hinge 130.

The slide slope 310 may be formed at the upper end of the vertical link 300. The slide slope 310 may be an inclined surface of the vertical link 300. For example, the slide slope 310 may be a surface inclined downward toward the guide 210 of the horizontal link 200.

That is, the slide slope 310 may be an inclined surface having a first end lower than a second end. The first end of the slide slope 310 can be considered as the end facing the horizontal link 200.

Accordingly, when the guide 210 is moved from the first end to the second end of the slide slope 310, the vertical ink 300 can be moved downward by the force applied to the inclined surface of the slide slope 310.

The coupling portion 310 may be formed at the lower portion of the vertical link 300. For example, the coupling portion 320 may be formed such that the coupling hinge 130 can be inserted into the vertical link 300 from the lower end of the vertical link 300.

That is, the coupling portion 320 can be coupled to and decoupled from the coupling hinge 130. For example, the coupling hinge 130 can be inserted in the coupling portion 320 in the second mode.

The vertical link 300 may further include a vertical elastic member 350 providing elasticity for returning the vertical link 300 and a vertical mount 330 where the vertical elastic member 350 is disposed.

The vertical mount 330 may be formed at the lower portion of the vertical link 300. The vertical mount 330 may be a space recessed inward.

The vertical elastic member 350 may include a spring. The vertical elastic member 350 may be disposed in the vertical mount 330.

The vertical elastic member 350 can be stretched and contracted by movement of the vertical link 300.

The vertical elastic member 350 can be contracted when the vertical link 300 is moved down toward the down door groove 28 of both vertical directions of the door case 21.

The elasticity of the vertical elastic member 350 can be applied upward opposite to the movement direction of the vertical link 300.

Accordingly, when the horizontal link 200 is pressed by the operation unit 25, the guide 210 slides down on the slide slope 310, whereby the force pressing the slide slope 310 can be gradually decreased.

Accordingly, the vertical link 300 can be moved upward and returned to the initial position by the elasticity of the vertical elastic member 350. Further, the vertical link 300 can be move upward and separated from the coupling hinge 130.

The vertical elastic member 350 may be smaller in modulus of elasticity than the horizontal elastic member 250. In detail, the horizontal link 200 can be returned to the initial position by the elasticity of the horizontal elastic member 250 and the elasticity can be transmitted to the slide slope 310.

Accordingly, the vertical link 300 can be moved downward by the force that is transmitted to the slide slope 310 from the horizontal link 200. The vertical elastic member 350 can be contracted.

That is, since the horizontal elastic member 250 is larger in modulus of elasticity than the vertical elastic member 350, the elasticity of the horizontal elastic member 250 can be applied to the vertical link 300 against the reacting force of the contracted vertical elastic member 350.

The horizontal link is referred to as a first link and the vertical link is referred to as a second link.

As described above, the coupling hinge 130 can be separably coupled to a vertical link 300.

In detail, the coupling hinge 130 may have a coupling base 131 coupled to the cabinet 11, a connecting portion 136 inserted in the coupling base 131 to be rotatable about the lower end of the cabinet 11, and a down shaft 135 providing the rotary shaft for the coupling portion 136 by connecting the coupling base 131 and the coupling portion 136.

The coupling base 131 may protrude forward from the cabinet 11 and inclined upward. A groove may be formed at the extending end of the coupling base 131 for rotation of the coupling portion 136.

The coupling portion 136 can be inserted and fastened in the groove of the coupling base 131 by the down shaft 135.

The down shaft 135 may be positioned in the extension direction of the lower end of the cabinet 11. The coupling portion 136 can rotate on the down shaft 135. That is, the coupling portion 136 can guide the door 20 such that the door 20 can be rotated in a pull-down type.

The coupling portion 136 may have a hexahedral bar. The upper end of the coupling portion 136 may be fastened or coupled to the coupling portion 320 of the vertical link 300. For example, the coupling portion 135 can be coupled to the coupling portion 320 when the vertical link 300 is moved downward and can be separated from the coupling portion 320 when the vertical link 300 is moved upward.

As described above, the rotary hinge 110 can be coupled to fix and support the door 200 and may allow the door 20 to rotate different direction, depending on the first mode and the second mode.

In detail, referring to FIG. 5, the rotary hinge 110 may have a coupling base 111 having the same shape as the coupling base 131 of the coupling hinge 130.

The coupling base 111 of the rotary hinge 110 may protrude forward from the front of the cabinet 11.

The rotary hinge 110 may further have a rotary rib 116 inserted in the coupling base 111 to be rotatable about the lower end of the cabinet 11, a down shaft 115 providing a rotary shaft for the rotary rib 116 by connecting the rotary rib 116 and the coupling base 111, and a side shaft 118 extending upward from the rotary rib 116 and coupled to the door case 21.

The coupling base 111 of the rotary hinge 110 is referred to as a first coupling base and the coupling base 131 of the coupling hinge 130 is referred to as a second coupling base. The down shaft 115 of the rotary hinge 110 is referred to as a first down shaft and the down shaft 135 of the coupling hinge 130 is referred to as a second down shaft.

The rotary rib 116 can rotate about the first down shaft 115. That is, the rotary rib 116 can guide the door 20 in cooperation with the coupling portion 136 such that the door 20 can be rotated in a pull-down type.

The rotary rib 116 may be formed in an L-shape. The lower end of the rotary rib 116 can be inserted in the groove of the first coupling base 111 and fastened by the first down shaft 115.

The side shaft 118 may extend upward from the top of the rotary rib 116. That is, the side shaft 118 and the first down shaft 115 may be perpendicular to each other.

The side shaft 118 may be inserted and fixed in the lower end of the door case 21. The side shaft 118 can guide the door in cooperation with the shaft of the fixed hinge 120 such that the door 20 can be rotated in a side-swing type.

Figure 6:
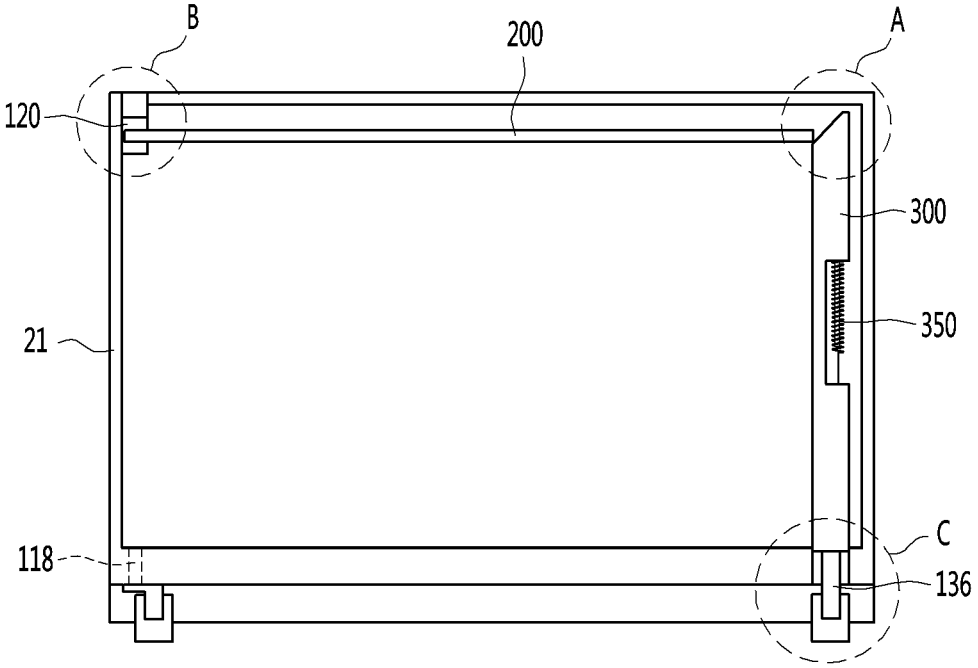
FIG. 6 is a view showing the connection state when the door according to an embodiment of the present invention is in the first mode.
Figure 7A:
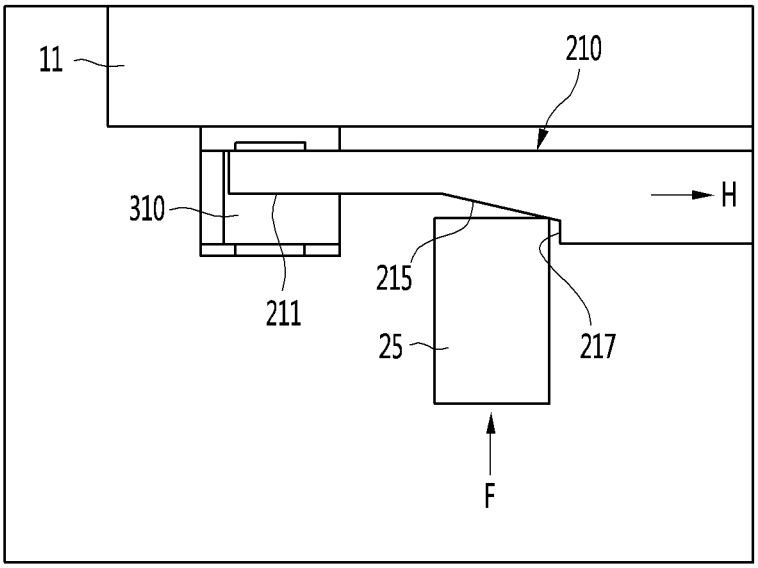
FIGS. 7A and 7B are enlarged plan views exemplarily showing that the part 'A' of FIG. 6 is changed into the first mode.
Figure 7B:
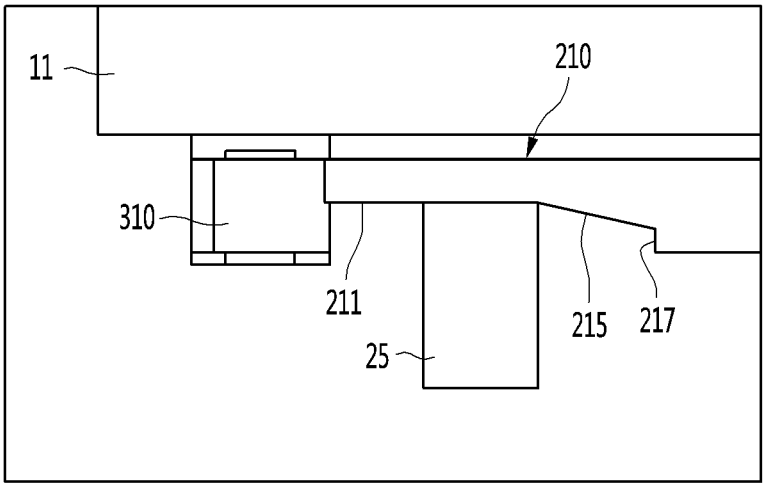
Figure 8A:
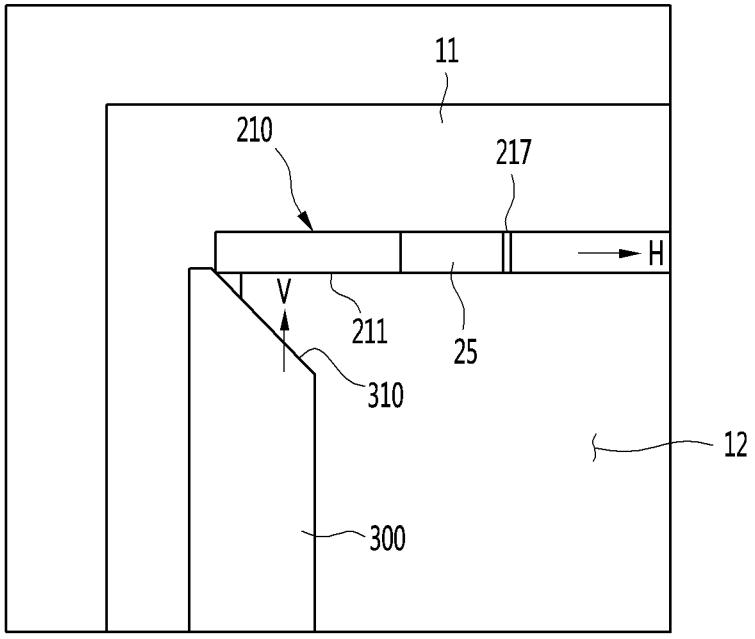
FIGS. 8A and 8B are enlarged front views exemplarily showing that the part 'A' of FIG. 6 is changed into the first mode.
Figure 8B:
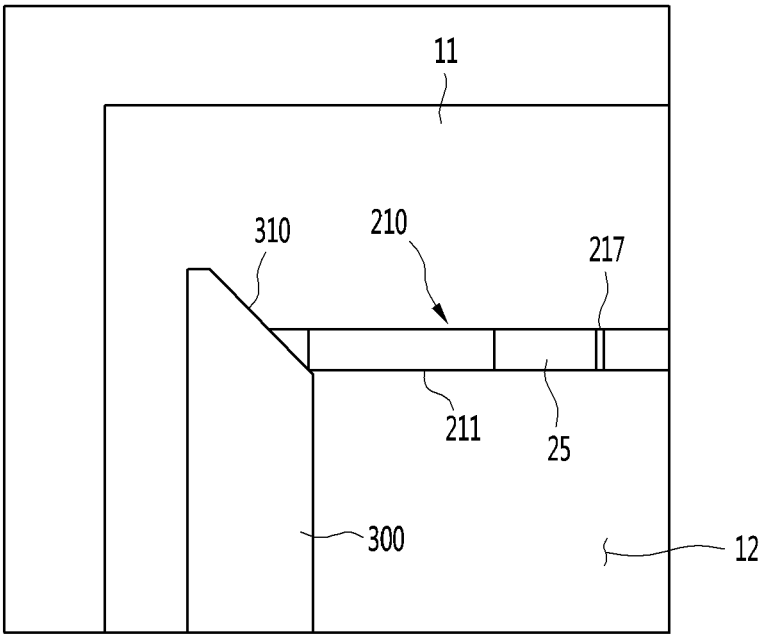
Figure 9A:
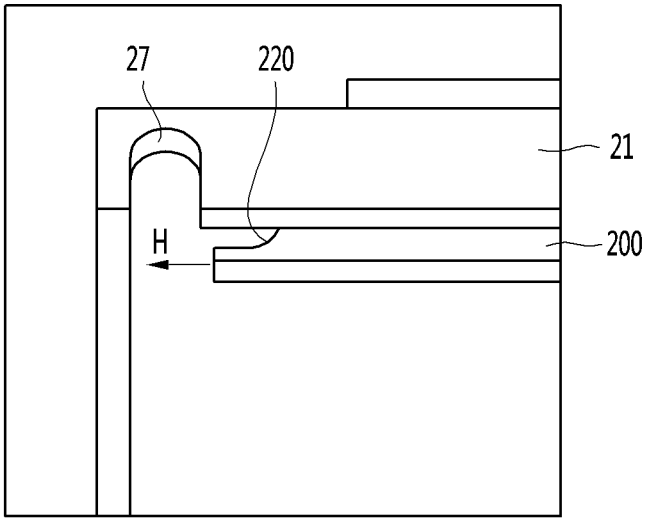
FIGS. 9A and 9B are enlarged views exemplarily showing that the part 'A' of FIG. 6 is changed into the first mode.
Figure 9B:
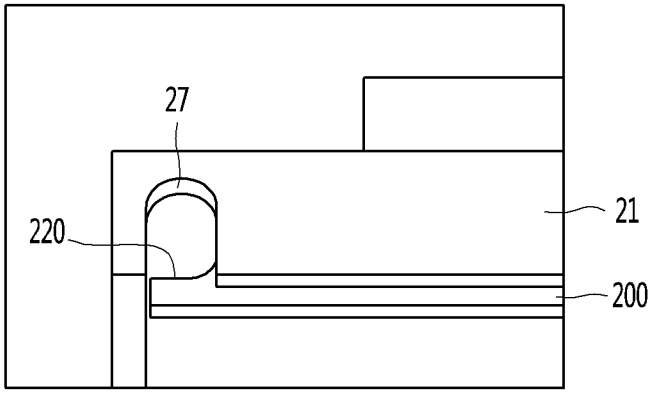
Figure 10A:
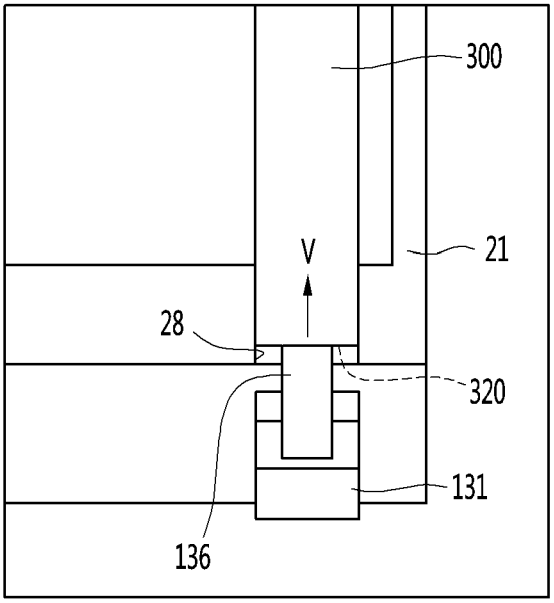
FIGS. 10A and 10B are enlarged views exemplarily showing that the part 'C' of FIG. 6 is changed into the first mode.
Figure 10B:
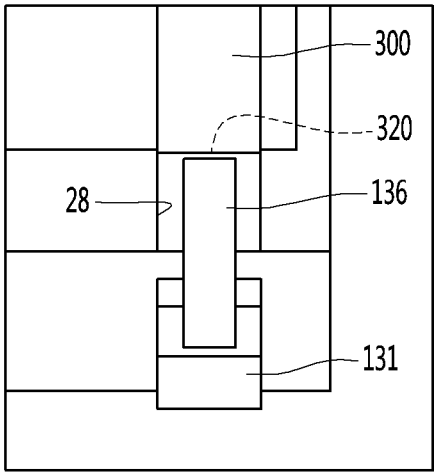

FIG. 6 is a view showing the connection state when the door according to an embodiment of the present invention is in the first mode, FIGS. 7A and 7B are enlarged plan views exemplarily showing that the part 'A' of FIG. 6 is changed into the first mode, FIGS. 8A and 8B are enlarged front views exemplarily showing that the part 'A' of FIG. 6 is changed into the first mode, FIGS. 9A and 9B are enlarged views exemplarily showing that the part 'A' of FIG. 6 is changed into the first mode, and FIGS. 10A and 10B are enlarged views exemplarily showing that the part 'C' of FIG. 6 is changed into the first mode.

The operation of making the door 20 enter the first mode is described with reference to FIGS. 6 to 10B. In detail, FIGS. 7A, 8A, 9A, and 10A show the connection state of the horizontal link 200 and the vertical link 300 when the door 20 is in the second mode (a pull-down type). In detail, FIGS. 7B, 8B, 9B, and 10B show the connection state of the horizontal link 200 and the vertical link 300 when the door 20 is in the first mode (a side-swing type).

Accordingly, the operation of changing into the first mode from the second mode is described with reference to FIGS. 7A to 10B, and the operation of changing into the second mode from the first mode is described with reference to the reverse of the previous process.

Referring to FIGS. 7A, 7B, 8A, and 8B, a user can press the operation unit 25 with the handle 23 in his/her hand. The operation unit 25 is pressed backward in the direction F in which the force applied by the user acts, thereby being able to press the inclined portion 215. For example, an edge of the operation unit 25 can press the portion of the stopping portion 217 that it initially comes in contact with, that is, can press the forefront end of the inclined portion 215.

The inclined portion 215 can be moved in a predetermined direction by the operation unit 25. That is, the point of application by the operation unit 25 coming in contact with the inclined portion 215 continuously changes in the inclined direction of the inclined portion 215 from an end to the other end of the inclined portion 215.

Accordingly, the horizontal link 200 is moved in one direction H of both lateral directions of the door case 21.

The pressing portion 211 is also moved in the direction H, so the pressing portion 211 slides from the top to the bottom of the slide slope 310.

The pressing portion 211 can be easily moved in the direction H by the inclination of the slide slope 310, so the force pressing down the slide slope 310 can be gradually decreased.

Accordingly, the elasticity accumulated by contraction of the vertical elastic member 350 becomes larger than the force pressing down the slide slope 310, so the vertical link 300 can be moved upward V.

Referring to FIGS. 9A and 9B, when the horizontal link 200 is moved in the direction H, the link groove 220 can be positioned under the side door groove 27 in which the fixed hinge 120 inserted. The link groove 220 can be connected to the outer side of the fixed hinge 120.

Furthermore, referring to FIGS. 10A and 10B, as the vertical link 300 is moved upward, the coupling portion 320 and the coupling hinge 130 can be separated from each other. Accordingly, the lower end of the vertical link 300 can be completely separated from the coupling hinge 130.

Therefore, the door 20 enters the first mode in which it can be rotated about the fixed hinge 120 and the side shaft 118.

Figure 11:
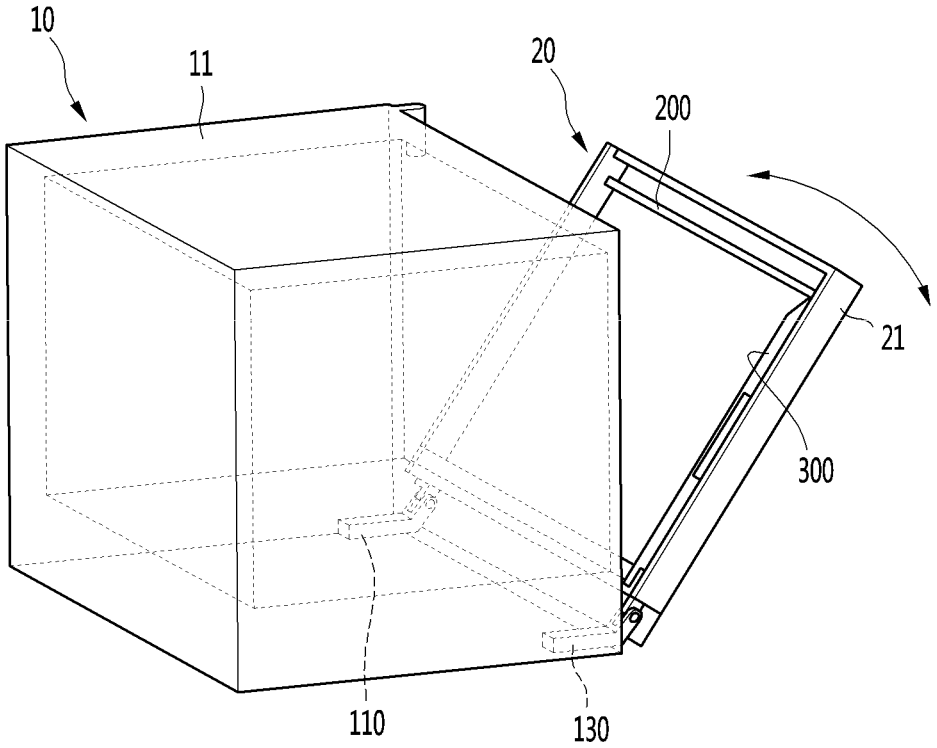
FIG. 11 is a view showing that a door according to an embodiment of the present invention is opened in a second mode.
Figure 12:
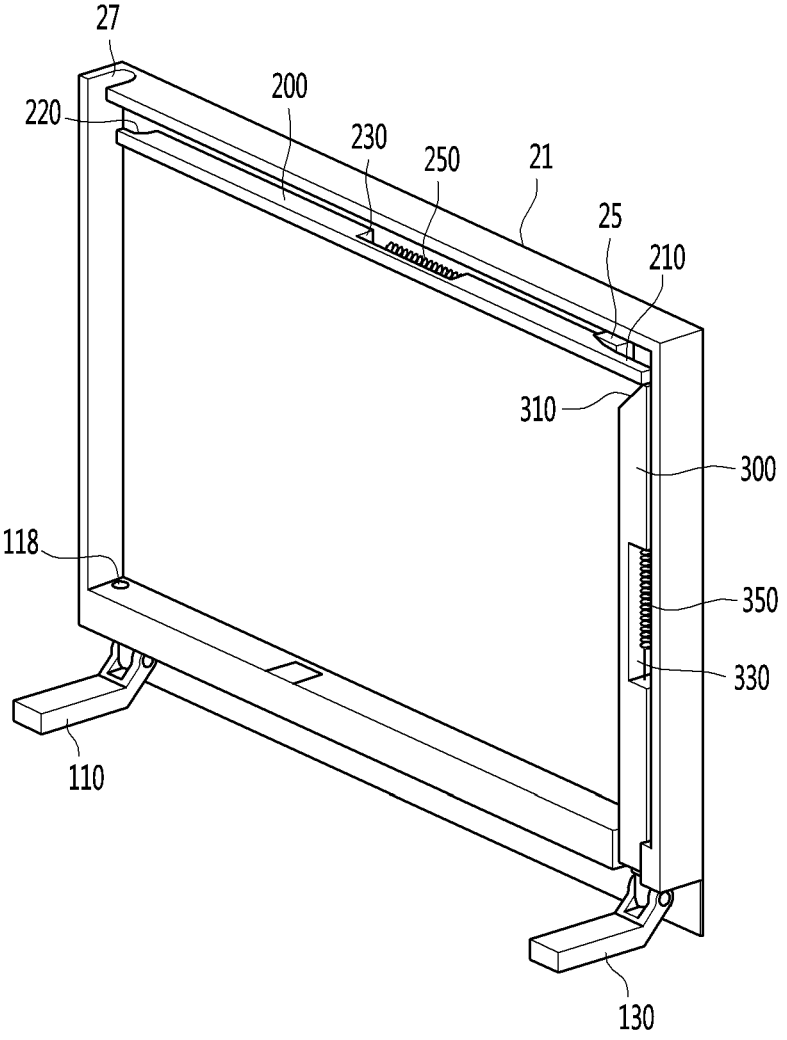
FIG. 12 is a perspective view showing the second mode of the door according to an embodiment of the preset invention.

FIG. 11 is a view showing that a door according to an embodiment of the present invention is opened in a second mode, FIG. 12 is a perspective view showing the second mode of the door according to an embodiment of the preset invention, and FIG. is a view showing the connection state when the door according to an embodiment of the present invention is in the second mode.

Figure 13:
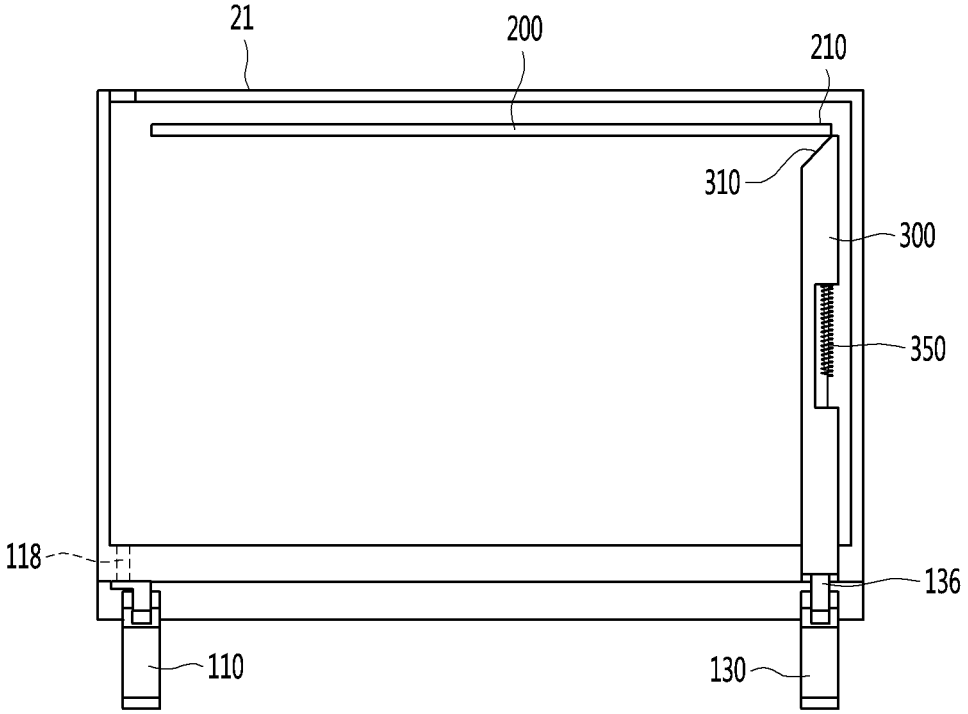
FIG. 13 is a view showing the connection state when the door according to an embodiment of the present invention is in the second mode.

The operation of changing the door 20 into the second mode from the first mode is described with reference to FIGS. 11 to 13 and the reverse of the process of entering the first mode.

As described above, when the horizontal link 200 is moved in the direction H, the horizontal elastic member 250 can be contracted.

When a user releases the pressed operation unit 25, the operation unit 25 can protrude backward.

Accordingly, the force pressing the horizontal link 200 by the operation unit 25 is removed, so the horizontal link 200 can be moved in the other direction opposite to the direction H by the elasticity of the horizontal elastic member 250. That is, the link groove 220 and the fixed hinge 120 are separated from each other and the horizontal link 200 can be returned to the initial position.

The door 20 can be changed into the second mode from the first mode.

In detail, as the horizontal link 200 is returned, the pressing portion 211 can also be moved in the other direction. As the pressing portion 211 is moved, force is obliquely applied to the sliding slope 310 that has come in contact with the bottom of the pressing portion 211 in the first mode.

The pressing portion 211 can continuously transmit force by sliding on the slide slope 310 from the bottom to the top of the sliding slope 310. Accordingly, the vertical link 300 can be moved downward by the pressing portion moving on the slope.

AS the vertical link 300 is moved downward, the vertical elastic member 350 can be contracted. Further, the coupling hinge 130 can be inserted back into the coupling portion 320.

Therefore, the door 20 enters the second mode in which it can be rotated about the rotary hinge 110 and the down shafts 115 and 135 of the coupling hinge 130.

The horizontal elastic member 250 is referred to as a first elastic member and the vertical elastic member 350 is referred to as a second elastic member.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or includes or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the spirit and scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

What is claimed is:

1. An oven comprising:

a cabinet that defines a cooking space and that defines an opening at a front of the cabinet;

a door configured to rotate relative to the cabinet to open and close at least a portion of the opening at the front of the cabinet; and a rotary hinge that is located at the front of the cabinet and that allows the door to rotate relative to the cabinet in a plurality of rotation directions, wherein the door includes:

a door case, a handle located at a front of the door case, a first link configured to move in a first direction relative to the cabinet, a second link configured to, based on movement of the first link in the first direction, move in a second direction that is perpendicular to the first direction, and an operation unit that is located at the handle, that is configured to cause the first link to move relative to the cabinet, and that is configured to pass through the door case to press the first link, and wherein the door is configured to rotate in a first rotation direction among the plurality of rotation directions based on movement of the first link relative to the cabinet.

2. The oven according to claim 1, wherein the operation unit is configured to press the first link in a direction that is perpendicular to the first direction and to the second direction.

3. The oven according to claim 1, wherein the first direction comprises a first lateral direction toward a first side of the door and a second lateral direction toward a second side of the door, and wherein the second direction is a vertical direction of the cabinet.

4. The oven according to claim 3, wherein the second link is configured to:

move upward based on the first link moving toward the first side of the door in the first lateral direction; and move downward based on the first link moving toward the second side of the door in the second lateral direction.

5. The oven according to claim 1, wherein the first link includes a guide configured to contact the operation unit and the second link.

6. The oven according to claim 5, wherein the second link includes a slide slope that is inclined with respect to the second direction, and wherein the guide is configured to move relative to the slide slope in a state in which the guide contacts the slide slope.

7. The oven according to claim 1, wherein the first link is configured to press an upper end of the second link.

8. The oven according to claim 1, wherein the first link includes a first elastic member configured to provide first elastic force that causes the first link to move to an initial position of the first link.

9. The oven according to claim 8, wherein the second link includes a second elastic member configured to provide second elastic force that causes the second link to move to an initial position of the second link.

10. The oven according to claim 9, wherein an elastic modulus of the first elastic member is greater than an elastic modulus of the second elastic member.

11. The oven according to claim 9, wherein the second elastic member is configured to be stretched based on the first elastic member being compressed.

12. The oven according to claim 1, further comprising:

a coupling hinge located at the cabinet and spaced apart from the rotary hinge in the first direction; and a fixed hinge located at the cabinet and spaced apart from the rotary hinge in the second direction.

13. The oven according to claim 12, wherein the door is configured to open and close at least a portion of the opening at the front of the cabinet (i) in a first mode in which the door rotates about a side end of the cabinet or (ii) in a second mode in which the door rotates about a lower end of the cabinet.

14. The oven according to claim 12, wherein the first link is configured to couple to the fixed hinge.

15. The oven according to claim 12, wherein the second link is configured to couple to the coupling hinge.

16. The oven according to claim 13, wherein the first link is configured to couple to the fixed hinge in the first mode, and to separate from the fixed hinge in the second mode.

17. The oven according to claim 13, wherein the second link is configured to separate from the fixed hinge in the first mode, and to couple to the fixed hinge in the second mode.

18. An oven comprising:

a cabinet that defines a cooking space and that defines an opening at a front of the cabinet;

a door configured to rotate relative to the cabinet to open and close at least a portion of the opening at the front of the cabinet; and a rotary hinge that is located at the cabinet and that allows the door to rotate relative to the cabinet in a plurality of rotation directions, wherein the door includes:

a first link configured to move in a first direction relative to the cabinet, and a second link configured to, based on movement of the first link in the first direction, move in a second direction that is perpendicular to the first direction, and wherein the door is configured to, based on movement of the first link in the first direction, open and close at least a portion of the opening at the front of the cabinet (i) in a first mode in which the door rotates about a side end of the cabinet or (ii) in a second mode in which the door rotates about a lower end of the cabinet, wherein the rotary hinge includes:

a coupling base coupled to the cabinet, a rotary rib connected to the coupling base and configured to, in the first mode, rotate about a rotary shaft relative to the coupling base, and a side shaft that extends in a direction that is perpendicular to the rotary shaft of the rotary rib.

19. The oven according to claim 18, wherein the rotary hinge is coupled to a side of a lower end of the cabinet.

20. The oven according to claim 18, wherein the coupling base protrudes from a front of the cabinet.

21. The oven according to claim 18, wherein the rotary hinge further includes a down shaft configured to connect the rotary rib to the coupling base.

* * * * *